US008613175B2

(12) United States Patent
Hohmann, Jr.

(10) Patent No.: US 8,613,175 B2
(45) Date of Patent: Dec. 24, 2013

(54) HIGH-STRENGTH PINTLES AND ANCHORING SYSTEMS UTILIZING THE SAME

(75) Inventor: Ronald P. Hohmann, Jr., Hauppauge, NY (US)

(73) Assignee: MiTek Holdings, Inc., Wilmington, DE (US)

( * ) Notice: Subject to any disclaimer, the term of this patent is extended or adjusted under 35 U.S.C. 154(b) by 0 days.

(21) Appl. No.: 13/241,642

(22) Filed: Sep. 23, 2011

(65) Prior Publication Data

US 2013/0074442 A1 Mar. 28, 2013

(51) Int. Cl.
*E04B 1/16* (2006.01)

(52) U.S. Cl.
USPC ..... 52/379; 52/513; 52/712; 52/713

(58) Field of Classification Search
USPC ..... 52/513, 379, 712, 713
See application file for complete search history.

(56) References Cited

U.S. PATENT DOCUMENTS

| | | | | |
|---|---|---|---|---|
| 819,869 | A | | 5/1906 | Dunlap |
| 1,794,684 | A | | 3/1931 | Handel |
| 2,097,821 | A | | 11/1937 | Mathers |
| 2,605,867 | A | | 8/1952 | Goodwin |
| 2,780,936 | A | | 2/1957 | Hillberg |
| 2,929,238 | A | | 3/1960 | Kaye |
| 3,030,670 | A | | 4/1962 | Bigelow |
| 3,277,626 | A | * | 10/1966 | Brynjolfsson et al. ..... 52/713 |
| 3,300,939 | A | | 1/1967 | Brynjolfsson et al. |
| 3,309,828 | A | | 3/1967 | Tribble |
| 3,341,998 | A | | 9/1967 | Lucas |
| 3,377,764 | A | * | 4/1968 | Storch ..... 52/713 |
| 3,568,389 | A | | 3/1971 | Gulow |
| 4,021,990 | A | | 5/1977 | Schwalberg |
| 4,227,359 | A | | 10/1980 | Schlenker |
| 4,238,987 | A | | 12/1980 | Siebrecht-Reuter |
| 4,373,314 | A | | 2/1983 | Allan |
| 4,473,984 | A | | 10/1984 | Lopez |
| 4,596,102 | A | | 6/1986 | Catani et al. |
| 4,598,518 | A | | 7/1986 | Hohmann |
| 4,660,342 | A | | 4/1987 | Salisbury |
| 4,708,551 | A | | 11/1987 | Richter et al. |
| 4,738,070 | A | | 4/1988 | Abbott et al. |
| 4,827,684 | A | | 5/1989 | Allan |
| 4,843,776 | A | | 7/1989 | Guignard |
| 4,852,320 | A | | 8/1989 | Ballantyne |
| 4,869,038 | A | * | 9/1989 | Catani ..... 52/410 |
| 4,875,319 | A | | 10/1989 | Hohmann |
| 4,946,632 | A | | 8/1990 | Pollina |
| 4,955,172 | A | | 9/1990 | Pierson |
| 5,099,628 | A | | 3/1992 | Noland et al. |

(Continued)

OTHER PUBLICATIONS

Office Action issued Apr. 12, 2013 in related U.S. Appl. No. 13/469,952, 21 pgs.

*Primary Examiner* — Basil Katcheves
*Assistant Examiner* — Joshua Ihezie
(74) *Attorney, Agent, or Firm* — Silber & Fridman

(57) ABSTRACT

A high-strength ribbon pintle and cavity wall anchoring system employing the same is disclosed. The ribbon pintle is a wire formative construct that is cold-worked with the resultant body having substantially semicircular edges and flat surfaces therebetween. The edges are aligned to receive compressive forces transmitted from the outer wythe. The ribbon pintles hereof, when part of the anchoring system, interengage with receptor portions of a wall anchor and are dimensioned to preclude significant movement lateral with or normal to the inner wythe.

26 Claims, 7 Drawing Sheets

(56) References Cited

U.S. PATENT DOCUMENTS

| | | | | |
|---|---|---|---|---|
| 5,207,043 | A | 5/1993 | McGee et al. | |
| 5,392,581 | A | 2/1995 | Hatzinikolas et al. | |
| 5,408,798 | A * | 4/1995 | Hohmann | 52/562 |
| 5,440,854 | A | 8/1995 | Hohmann | |
| 5,454,200 | A * | 10/1995 | Hohmann | 52/513 |
| 5,456,052 | A | 10/1995 | Anderson et al. | |
| 5,598,673 | A | 2/1997 | Atkins | |
| 5,634,310 | A * | 6/1997 | Hohmann | 52/513 |
| 5,671,578 | A * | 9/1997 | Hohmann | 52/562 |
| 5,816,008 | A | 10/1998 | Hohmann | |
| 6,209,281 | B1 | 4/2001 | Rice | |
| 6,279,283 | B1 * | 8/2001 | Hohmann et al. | 52/379 |
| 6,332,300 | B1 | 12/2001 | Wakai | |
| 6,351,922 | B1 | 3/2002 | Burns et al. | |
| 6,668,505 | B1 * | 12/2003 | Hohmann et al. | 52/565 |
| 6,735,915 | B1 * | 5/2004 | Johnson, III | 52/379 |
| 6,739,105 | B2 * | 5/2004 | Fleming | 52/513 |
| 6,789,365 | B1 * | 9/2004 | Hohmann et al. | 52/565 |
| 6,851,239 | B1 * | 2/2005 | Hohmann et al. | 52/513 |
| 6,941,717 | B2 * | 9/2005 | Hohmann et al. | 52/506.01 |
| 7,017,318 | B1 * | 3/2006 | Hohmann et al. | 52/562 |
| 7,147,419 | B2 | 12/2006 | Balbo Di Vinadio | |
| 7,325,366 | B1 * | 2/2008 | Hohmann et al. | 52/513 |
| 7,562,506 | B2 * | 7/2009 | Hohmann, Jr. | 52/714 |
| 7,587,874 | B2 * | 9/2009 | Hohmann, Jr. | 52/714 |
| 7,735,292 | B2 * | 6/2010 | Massie | 52/742.14 |
| 8,096,090 | B1 * | 1/2012 | Hohmann et al. | 52/513 |
| 8,201,374 | B2 * | 6/2012 | Hohmann, Jr. | 52/379 |
| 8,347,581 | B2 | 1/2013 | Doerr et al. | |
| 8,418,422 | B2 | 4/2013 | Johnson, III | |
| 8,511,041 | B2 | 8/2013 | Fransen | |
| 8,516,768 | B2 | 8/2013 | Johnson, III | |
| 2001/0054270 | A1 | 12/2001 | Rice | |
| 2004/0083667 | A1 * | 5/2004 | Johnson, III | 52/379 |
| 2008/0092472 | A1 | 4/2008 | Doerr et al. | |
| 2011/0041442 | A1 | 2/2011 | Bui | |
| 2011/0083389 | A1 | 4/2011 | Bui | |

* cited by examiner

HIGH-STRENGTH PINTLES AND ANCHORING SYSTEMS UTILIZING THE SAME

BACKGROUND OF THE INVENTION

1. Field of the Invention

This invention relates to an improved anchoring arrangement for use in conjunction with cavity walls having an inner wythe and an outer wythe. More particularly, the invention relates to construction accessory devices, namely, veneer ties with high-strength ribbon pintles. The veneer ties are for emplacement in the outer wythe and are further accommodated by receptors in the cavity, which receptors extend from the inner wythe to encapture the specially configured pintles hereof. The invention is applicable to structures having an outer wythe of brick or stone facing in combination with an inner wythe of either masonry block or dry wall construction.

2. Description of the Prior Art

In the past, investigations relating to the effects of various forces, particularly lateral forces, upon brick veneer masonry construction demonstrated the advantages of having high-strength wire anchoring components embedded in the bed joints of anchored veneer walls, such as facing brick or stone veneer.

Prior tests have shown that failure of anchoring systems frequently occur at the juncture between the pintle of the veneer tie and the receptor portion of the wall anchor. This invention addresses the need for a high-strength pintle suitable for use with both a masonry block or dry wall construction and provides a strong pintle-to-receptor connection.

Early in the development of high-strength anchoring systems a prior patent, namely U.S. Pat. No. 4,875,319 ('319), to Ronald P. Hohmann, in which a molded plastic clip is described as tying together reinforcing wire and a veneer tie. The assignee of '319, Hohmann & Barnard, Inc., now a MiTek-Berkshire Hathaway company, successfully commercialized the device under the SeismiClip trademark. For many years the white plastic clip tying together the veneer anchor and the reinforcement wire in the outer wythe has been a familiar item in commercial seismic-zone buildings.

Additionally, the high-strength pintle hereof has been combined with the swaged back leg as shown in the inventor's patent, U.S. Pat. No. 7,325,366. The combination item reduces the number of "bits and pieces" brought to the job site and simplifies installation.

Recently, there have been significant shifts in public sector building specifications which have resulted in architects and architectural engineers requiring larger and larger cavities in the exterior cavity walls of public buildings. These requirements are imposed without corresponding decreases in wind shear and seismic resistance levels or increases in mortar bed joint height. Thus, the wall anchors needed are restricted to occupying the same ⅜-inch bed joint height in the inner and outer wythes. Thus, the veneer facing material is tied down over a span of two or more times that which had previously been experienced. Exemplary of the public sector building specification is that of the Energy Code Requirement, Boston, Mass. (See Chapter 13 of 780 CMR, Seventh Edition). This Code sets forth insulation R-values well in excess of prior editions and evokes an engineering response opting for thicker insulation and correspondingly larger cavities.

Besides earthquake protection requiring high-strength anchoring systems, the failure of several high-rise buildings to withstand wind and other lateral forces has resulted in the promulgation of more stringent Uniform Building Code provisions. The high-strength pintle is a partial response thereto.

The inventor's related anchoring system products have become widely accepted in the industry.

The following patents are believed to be relevant and are disclosed as being known to the inventor hereof:

| U.S. Pat. No. | Inventor | Issue Date |
|---|---|---|
| 3,377,764 | Storch | Apr. 16, 1968 |
| 4,021,990 | Schwalberg | May 10, 1977 |
| 4,373,314 | Allan | Feb. 15, 1983 |
| 4,473,984 | Lopez | Oct. 2, 1984 |
| 4,598,518 | Hohmann | Jul. 8, 1986 |
| 4,869,038 | Catani | Sep. 26, 1989 |
| 4,875,319 | Hohmann | Oct. 24, 1989 |
| 5,454,200 | Hohmann | Oct. 3, 1995 |
| 6,668,505 | Hohmann et al. | Dec. 30, 2003 |
| 6,789,365 | Hohmann et al. | Sep. 14, 2004 |
| 6,851,239 | Hohmann et al. | Feb. 8, 2005 |
| 7,017,318 | Hohmann | Mar. 28, 2006 |
| 7,325,366 | Hohmann | Feb. 5, 2008 |

It is noted that these devices are generally descriptive of wire-to-wire anchors and wall ties and have various cooperative functional relationships with straight wire runs embedded in the interior and/or exterior wythe.

U.S. Pat. No. 3,377,764—D. Storch—Issued Apr. 16, 1968 Discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977 Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314—J. A. Allan—Issued Feb. 15, 1983 Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984 Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,598,518—R. Hohmann—Issued Jul. 7, 1986 Discloses a dry wall construction system with wallboard attached to the face of studs which, in turn, are attached to an inner masonry wythe. Insulation is disposed between the webs of adjacent studs.

U.S. Pat. No. 4,869,038—M. J. Catani—Issued Sep. 26, 1989 Discloses a veneer wall anchor system having in the interior wythe a truss-type anchor, similar to Hala et al. '226 supra, but with horizontal sheetmetal extensions. The extensions are interlocked with bent wire pintle-type wall ties that are embedded within the exterior wythe.

U.S. Pat. No. 4,879,319—R. Hohmann—Issued Oct. 24, 1989 Discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 5,454,200—R. Hohmann—Issued October 1995 Discloses a facing anchor with straight wire run and mounted along the exterior wythe to receive the open end of wire wall tie with each leg thereof being placed adjacent one side of reinforcement wire. As the eye wires hereof have scaled eyelets or loops and the open ends of the wall ties are sealed in the joints of the exterior wythes, a positive interengagement results.

U.S. Pat. No. 6,668,505—Hohmann et al.—Issued Dec. 30, 2003 Discloses high-span and high-strength anchors and reinforcement devices for cavity walls combined with interlocking veneer ties are described which utilize reinforcing wire and wire formatives to form facing anchors, truss or ladder reinforcements, and wall anchors providing wire-to-wire connections therebetween.

U.S. Pat. No. 6,789,365—R. Hohmann et al.—Issued Sep. 14, 2004 Discloses side-welded anchor and reinforcement devices for a cavity wall. The devices are combined with interlocking veneer anchors, and with reinforcements to form unique anchoring systems. The components of each system are structured from reinforcing wire and wire formatives.

U.S. Pat. No. 6,851,239—Hohmann et al.—Issued Feb. 8, 2005 Discloses a high-span anchoring system described for a cavity wall incorporating a wall reinforcement combined with a wall tie which together serve a wall construct having a larger-than-normal cavity. Further the various embodiments combine wire formatives which are compressively reduced in height by the cold-working thereof. Among the embodiments is a veneer anchoring system with a low-profile wall tie for use in a heavily insulated wall.

U.S. Pat. No. 7,017,318—Hohmann—Issued Mar. 28, 2006 Discloses an anchoring system with low-profile wall ties in which insertion portions of the wall anchor and the veneer anchor are compressively reduced in height.

U.S. Pat. No. 7,325,366—Hohmann—Issued Feb. 5, 2008 Discloses snap-in veneer ties for a seismic construction system in cooperation with low-profile, high-span wall anchors.

None of the above anchors or anchoring systems provide a veneer tie having a high-strength pintle for fulfilling the need for enhanced compressive and tensile properties. This invention relates to an improved anchoring arrangement for use in conjunction with cavity walls having an inner wythe and an outer wythe and meets the heretofore unmet need described above.

SUMMARY

In general terms, the invention disclosed hereby is a high-strength pintle and an anchoring system utilizing the same for cavity walls having an inner and outer wythe. The system includes a wire-formative veneer tie for emplacement in the outer wythe. The high-strength construction system hereof is applicable to construction of a wall having an inner wythe which can either be of dry wall construction or masonry block and an outer wythe and to insulated and non-insulated structures. The wythes are in a spaced apart relationship and form a cavity therebetween. In the disclosed system, a unique combination of a wall anchor (attachable to either ladder- or truss-type reinforcement for masonry inner wythes or to metal studs of a dry wall construct), a wire veneer tie, and, optionally, a continuous wire reinforcement is provided. The invention contemplates that the veneer ties are wire formatives with high-strength pintles depending into the wall cavity for connections between the veneer tie and the wall anchor.

In the first embodiment of this invention, the inner wythe is constructed from a masonry block material, the masonry anchor is a wire formative attached to a ladder-type reinforcement in a manner similar to the wall anchor shown in Hohmann, U.S. Pat. No. 6,789,365. The eye wires there extend into the cavity between the wythes. Each pair of eye wires accommodates the interengagement therewith of the high-strength pintles of the veneer ties.

The veneer tie is then positioned so that the insertion end thereof is embedded in the bed joint of the outer wythe. The construction of the veneer tie results in an orientation upon emplacement so that the widest part of the pintle is subjected to compressive and tensile forces. As the eye wires have sealed eyelets or loops with predetermined dimensions the horizontal movement of the construct is restricted accordingly.

In a second embodiment with a masonry block inner wythe, a construct is shown that employs thicker than usual insulation requiring high-span components. The novel high-strength veneer tie is shown in a functional cooperative relationship with the high-span components.

In the third embodiment of this invention, the inner wythe is a dry wall construct. Here, the dry-wall anchor is a metal stamping and is attached by sheetmetal screws to the metal vertical channel members of the wall. Each dry-wall anchor accommodates in horizontally extending portions, the high-strength pintles of the wire formatives veneer tie. In this embodiment the insertion end of the veneer tie is then positioned on the outer wythe so that a continuous reinforcement wire can be snapped into and is secured to the outer wythe anchor. The snap-in feature of the anchor here replaces the traditional function of the seismic clip for accommodating a straight wire run (see U.S. Pat. No. 4,875,319) and receiving the open end of the box tie. This anchor and a straight wire run are embedded in the bed joint of the outer wythe.

It is an object of the present invention to provide in an anchoring system having an outer wythe and an inner wythe, a high-strength veneer tie that interengages a wall anchor which system further includes specially configured pintles in the veneer tie.

It is another object of the present invention to provide labor-saving devices to simplify seismic and nonseismic high-strength installations of brick and stone veneer and the securement thereof to an inner wythe.

It is yet another object of the present invention to provide a cold worked wire formative that is characterized by high resistance to compressive and tensile forces.

It is a further object of the present invention to provide an anchoring system for cavity walls comprising a limited number of component parts that are economical of manufacture resulting in a relatively low unit cost.

It is yet another object of the present invention to provide an anchoring system which restricts lateral and horizontal movements of the facing wythe with respect to the inner wythe, but is adjustable vertically.

It is a feature of the present invention that the veneer tie, after being inserted into the receptors therefor, the pintles are oriented so that the widest portion thereof is subjected to compressive to tensile forces.

It is another feature of the present invention that the veneer ties are utilizable with either a masonry block having aligned or unaligned bed joints or for a dry wall construct that secures to a metal stud.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

Figure 1:
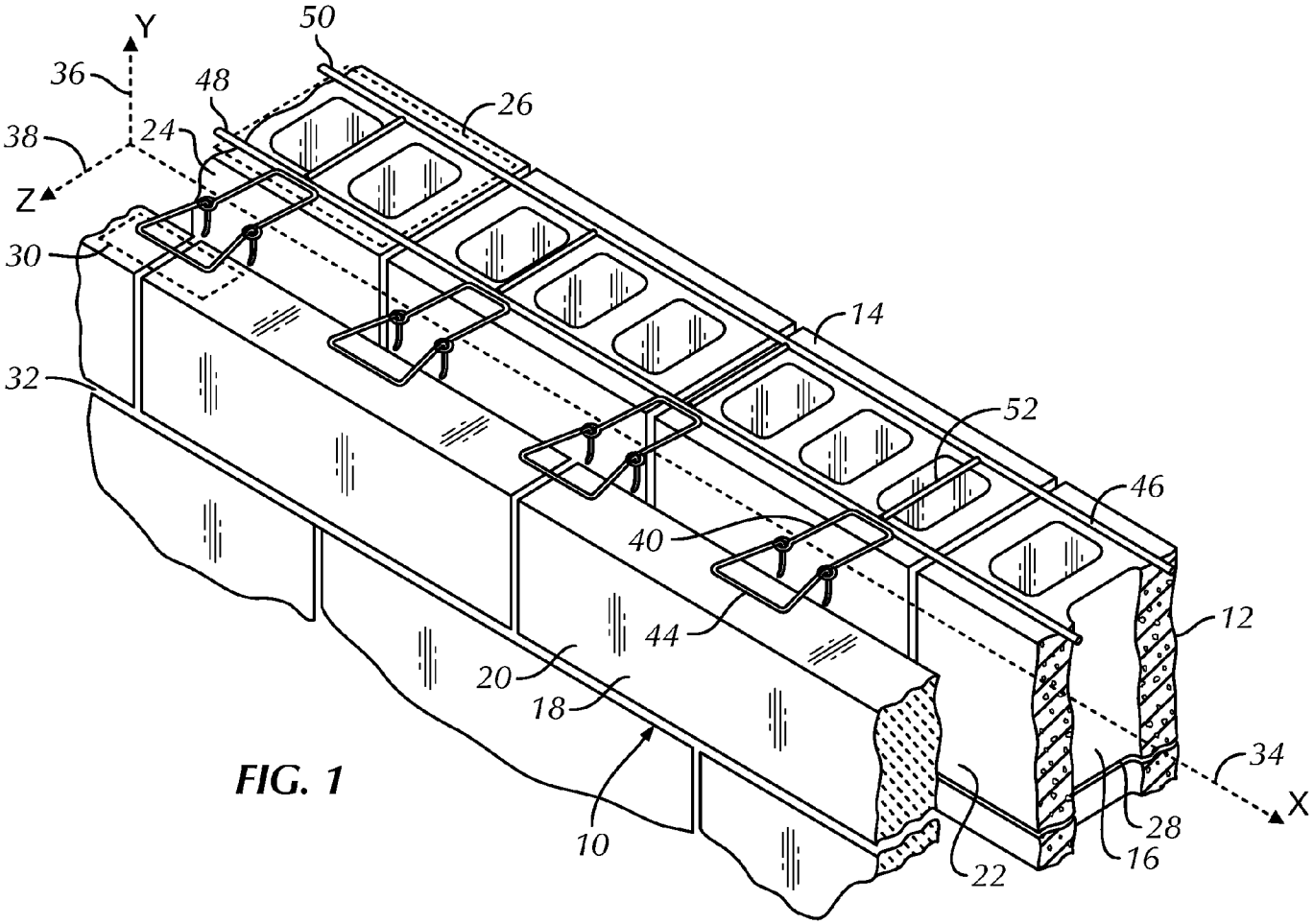
FIG. 1 is a perspective view of a first embodiment of an anchoring system having a veneer tie with high-strength pintles of this invention and side-welded, wall anchor and shows a wall with an inner wythe of masonry block and an outer wythe of brick veneer.

In the embodiments described herein the pintles of the wire components of the veneer ties are cold-worked or otherwise partially flattened resulting in greater tensile and compressive strength and thereby becoming better suited to cavity walls wherein high wind loads or seismic forces are experienced. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween. The deformed body has substantially the same cross-sectional area as the original wire. Here, the circular cross-section of a wire provides greater flexural strength than a sheetmetal counterpart.

Before proceeding to the detailed description, the following definitions are provided. For purposes of defining the invention at hand, a ribbon pintle is a wire formative that has been compressed by cold working so that the resultant body is substantially semicircular at the edges and has flat surfaces therebetween. In use the rounded edges are aligned so as to receive compressive forces transmitted from the veneer or outer wythe, which forces are generally normal to the facial plane thereof. In the discussion that follows the width of the ribbon pintle is also referred to as the major axis and the thickness is referred to as the minor axis.

As the compressive forces are exerted on the ribbon edges, the ribbon pintles withstand forces greater than uncompressed pintles formed from the same gage wire. Data reflecting the enhancement represented by the cold-worked ribbon pintles is included hereinbelow.

The description which follows is of three embodiments of anchoring systems utilizing the high-strength pintle veneer tie devices of this invention, which devices are suitable for nonseismic and seismic cavity wall applications. Two of the embodiments apply to cavity walls with masonry block inner wythes, and the remaining embodiment to a cavity wall with a dry wall (sheetrock) inner wythe. The wall anchor of the first embodiment is adapted from that shown in U.S. Pat. No. 6,789,365 of the inventors hereof.

Referring now to FIGS. 1 through 4 the first embodiment of the anchoring system hereof including a high-strength veneer tie of this invention is shown and is referred to generally by the number 10. In this embodiment, a wall structure 12 is shown having a backup wall or inner wythe 14 of masonry blocks 16 and a veneer facing or outer wythe 18 of facing brick or stone 20. Between the backup wall 14 and the facing wall 18, a cavity 22 is formed, which cavity 22 extends outwardly from surface 24 of backup wall 14.

In this embodiment, successive bed joints 26 and 28 are formed between courses of blocks 16 and the joints are substantially planar and horizontally disposed. Also, successive bed joints 30 and 32 are formed between courses of facing brick 20 and the joints are substantially planar and horizontally disposed. For each structure, the bed joints 26, 28, 30 and 32 are specified as to the height or thickness of the mortar layer and such thickness specification is rigorously adhered to so as to provide the uniformity inherent in quality construction. Selected bed joint 26 and bed joint 30 are constructed to align, that is to be substantially coplanar, the one with the other.

For purposes of discussion, the exterior surface 24 of the backup wall 14 contains a horizontal line or x-axis 34 and an intersecting vertical line or y-axis 36. A horizontal line or z-axis 38, normal to the xy-plane, also passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the x-axis. The device 10 includes a wall anchor 40 constructed for embedment in bed joint 26, which, in turn, includes two legs or traverse wire member 54 extending into cavity 22. Further, the device 10 includes a wire formative veneer tie or anchor 44 for embedment in bed joint 30.

Figure 2:
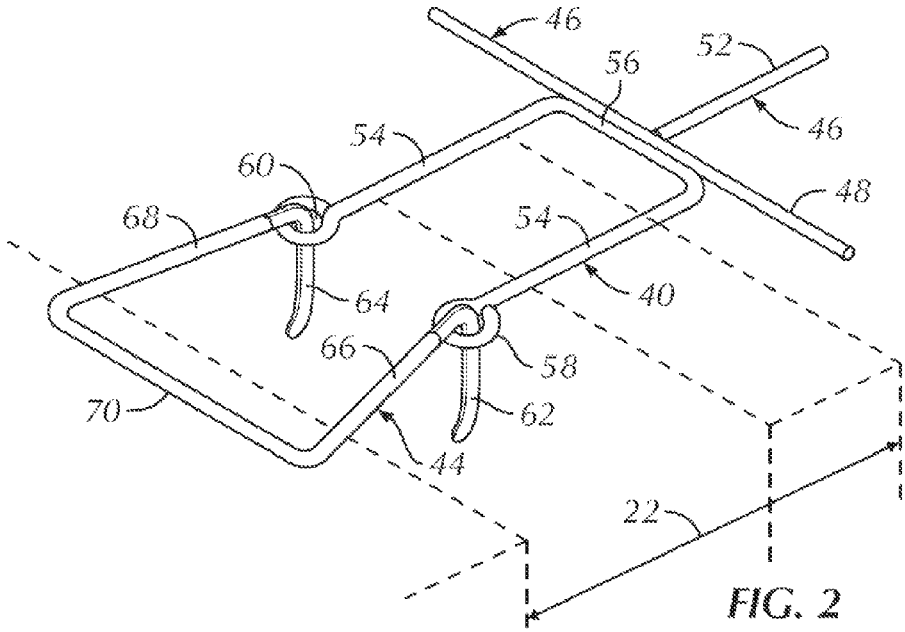
FIG. 2 is a partial perspective view of FIG. 1 showing details of the wall anchor and the veneer tie with high-strength pintles.
Figure 3:
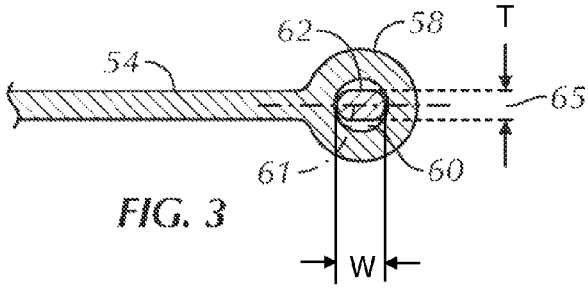
FIG. 3 is a partial cross-sectional view of the anchoring system of FIG. 2 on a substantially horizontal plane showing the receptor portion of the wall anchor and the pintle of the veneer tie.
Figure 4:
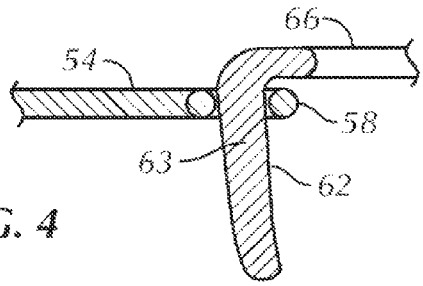
FIG. 4 is a partial cross-sectional view of the anchoring system of FIG. 2 on a substantially vertical plane showing the receptor portion of the wall anchor and the pintle of the veneer tie.

The wall anchor 40 is shown in FIGS. 1 and 2 as being emplaced on a course of blocks 16 in preparation for embedment in the mortar of bed joint 26. In the best mode of practicing this embodiment, a ladder-type wall reinforcement wire portion 46 is constructed of a wire formative with two parallel continuous straight wire members 48 and 50 spaced so as, upon installation, to each be centered along the outer walls of the masonry blocks 16. An intermediate wire bodies or cross rods 52 are interposed therebetween and connect wire members 48 and 50 forming rung-like portions of the ladder structure 46.

At intervals along the wall reinforcement 46, spaced pairs of transverse wire members or legs 54 are attached thereto and are attached to each other by a rear leg 56 therebetween. These pairs of wire members 54 extend into cavity 22 to veneer tie 44. As will become clear by the description which follows, the spacing between the transverse wire member 54 is constructed to limit the x-axis movement of the construct.

Each transverse wire member 54 has at the end opposite the attachment end an eyelet or receptor portion 58 formed contiguously therewith.

Upon installation, the eye or aperture 60 of receptor portion 58 is constructed to be within a substantially horizontal plane normal to exterior surface 24. The aperture 60 is dimensioned to accept a pintle of the veneer tie or anchor 44 therethrough and has a slightly larger opening than that required to accommodate the pintle. This relationship minimizes the movement of the construct in along a z-vector and in an xz-plane. For positive engagement, the aperture 60 of receptor portion 58 is sealed forming a closed loop.

The veneer tie 44 is, when viewed from a top or bottom elevation, generally U-shaped and is dimensioned to be accommodated by the pair of eye wires 58 previously described. The tie 44 has two leg portions or pintles 62 and 64, two side leg or spanning portions 66 and 68, and a connecting leg or insertion portion 70. As more clearly seen in FIGS. 3 and 4, the pintles have been compressively reduced so that, when viewed as installed, the pintle 62 cross-section taking in a horizontal or an xz-plane that includes the longitudinal axis of the receptor 58 shows the greatest dimension 61 substantially oriented along a z-vector. Similarly, when viewed as installed, the pintle cross-section taking in a vertical plane that includes the longitudinal axis of the wire member 54 shows the major axis dimension 61 substantially oriented along a z-vector.

The cross-sectional illustrations show the manner in which wythe-to-wythe and side-to-side movement is limited by the close fitting relationship between the compressively reduced pintles and the receptor openings. The minor axis 65 of the compressively reduced pintle 62 is optimally between 30 to 75% of the diameter of the wire formative and results in a veneer tie having compressive/tensile strength 140% of the original wire formative material. The pintle, once compressed, is ribbon-like in appearance; however, maintains substantially the same cross sectional area as the wire formative body.

Figure 5:
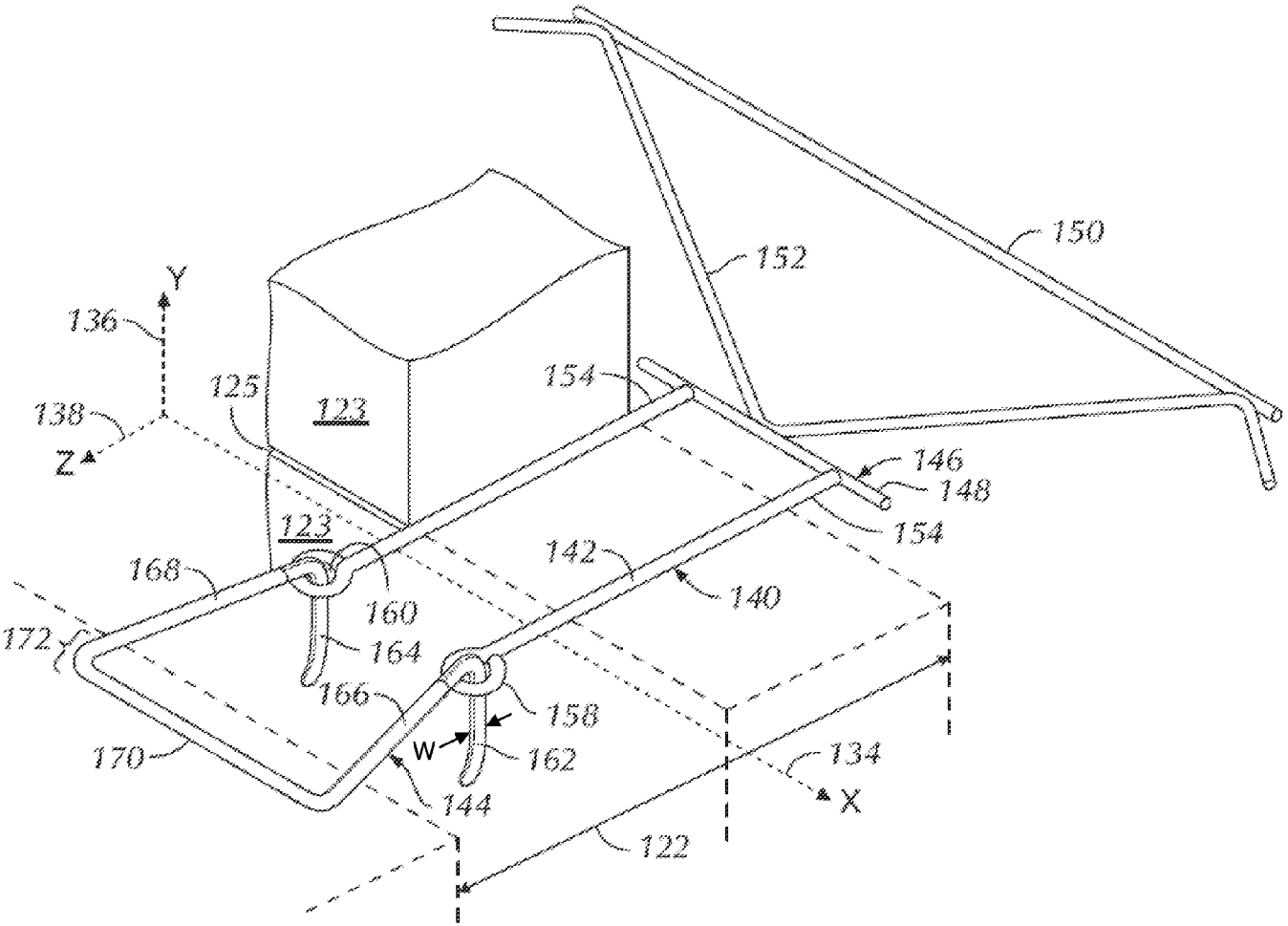
FIG. 5 is a perspective view of a second embodiment of an anchoring system having a veneer tie with high-strength pintles of this invention and a side-welded, wall anchor and shows a wall with a cavity to accommodate increased insulation.

The description which follows is of a second embodiment of the high-strength pintle anchoring system. In this embodiment the wall anchor portion is adapted from the high-span anchor and wall reinforcement device of U.S. Pat. No. 6,668,505 to Hohmann, et al. For ease of comprehension, where similar parts are shown, reference designators "100" units higher than those previously employed are used. Thus, the veneer tie 144 of the second embodiment is analogous to the veneer tie 44 of the first embodiment. Referring now to FIG. 5, the second embodiment of a high-strength pintle anchoring system of this invention is shown and is referred to generally by the numerals 140 for the wall anchor, 144 for the veneer tie, and 146 for the backup wall reinforcement. As this embodiment is similar to the first embodiment, the wall structure is not shown, but the wall structure of FIG. 1 is incorporated herein by reference.

The backup wall is insulated with strips of insulation 123 attached to the cavity surface of the backup wall and has seams 125 between adjacent strips coplaner with adjacent bed joints. In this embodiment, the cavity 122 is larger-than-normal and has a 5-inch span. For purposes of discussion, the exterior surface of the insulation 125 contains a horizontal line of x-axis 134 and an intersecting vertical line or y-axis 136. A horizontal line or z-axis 138, normal to the xy-plane, also passes through the coordinate origin formed by the intersecting x- and y-axes.

The wall anchor 140 is shown in FIG. 5 and has a free end or extension that spans the insulation portion or extension 142 for interconnection with veneer tie 144. In this embodiment, a truss-type wall reinforcement 146 is constructed of a wire formative with two parallel continuous straight side wire members 148 and 150 spaced so as, upon installation, to each be centered along the outer walls of the masonry blocks. An intermediate wire body 152 is interposed therebetween and is butt welded to wire members 148 and 150, thus separating and connecting side wires 148 and 150 of reinforcement 146.

At intervals along the truss-type reinforcement 146, spaced pairs of transverse wire members 154 are attached by electric resistance welding in accord with ASTM Standard Specification A951. These pairs of wire members 154 extend into the cavity 122. The spacing therebetween limits the x-axis movement of the construct. Each transverse wire member 154 has at the end opposite the attachment end an eyelet or receptor portion 158 formed continuous therewith. Upon installation, the receptor opening or throat 160 is constructed to be within a substantially horizontal or xz-plane, which is normal to the cavity walls. The receptor openings 160 is horizontally aligned to accept the downwardly bent ribbon pintle portion 162 of veneer tie 144 threaded therethrough. The receptor openings 160 are slightly greater than the width or major axis of the ribbon pintle 162 and the pintle portion fits snugly therewithin. These dimensional relationships minimize the x- and z-axis movement of the construct. For differing applications, the pintle portion of the veneer tie 144 is available in a variety of lengths.

In this embodiment, the veneer tie 144 is a cold-worked wire formative, and, when viewed from a top or bottom elevation, generally box-shaped. The veneer tie 144 is dimensioned so that the ribbon pintles 162 thereof have a major axis, defined hereinabove, nearing the opening or inner diameter of receptors 158. The ribbon pintle portions 162 are connected to rear leg 164, by side leg portions 166 and 168, which are substantially at right angles and attached to the ribbon pintle portions 162 and 164, respectively, and a front leg portion 170. An insertion portion 172 of veneer tie 144, upon installation extends beyond the cavity 122 into the bed joint of the facing wall (not shown). This portion includes front leg portion 170 and part of side leg portions 166 and 168. The longitudinal axes of side leg portions 166 and 168 and the longitudinal axis of the front leg portion 170 are substantially coplanar.

In the second embodiment in adapting the veneer tie 144 for high-strength applications, it is noted that the above-described arrangement of wire formatives is strengthened by the cold working thereof. In the past, while compressively altering wire formatives is taught by the patents of the inventors hereof, namely, U.S. Pat. Nos. 6,668,505 and 7,017,318, the teaching is to reduce the height of the wire formative inserted into the bed joint or between insulative panels. In this invention, in contrast to these past inventions, the compressive altering of wire formatives is found to enhance the strength of existing specified wire formatives to create anchoring systems with superior resistance to environmental forces, especially those exerted substantially normal to the exterior face of the outer wythe.

The ribbon pintles portions 162 and 164 of veneer tie 144 are considerably compressed and, while maintaining the same mass of material per linear unit as the adjacent wire formative, a thick ribbon is produced. The resultant width or major axis of the ribbon pintle portions 162 and 164 are increased so that, upon installation, the widths are dimensioned to have a close fitting relationship with receptor opening 160. The cold working enhances the mounting strength of veneer tie 144 and resist force vectors along the z-axis 138.

The description which follows is of a third embodiment of the high-strength pintle anchoring system. For ease of comprehension, where similar parts are used reference designators "200" units higher are employed. Thus, the veneer tie 244 of the third embodiment is analogous to the veneer tie 44 of the first embodiment.

Figure 6:
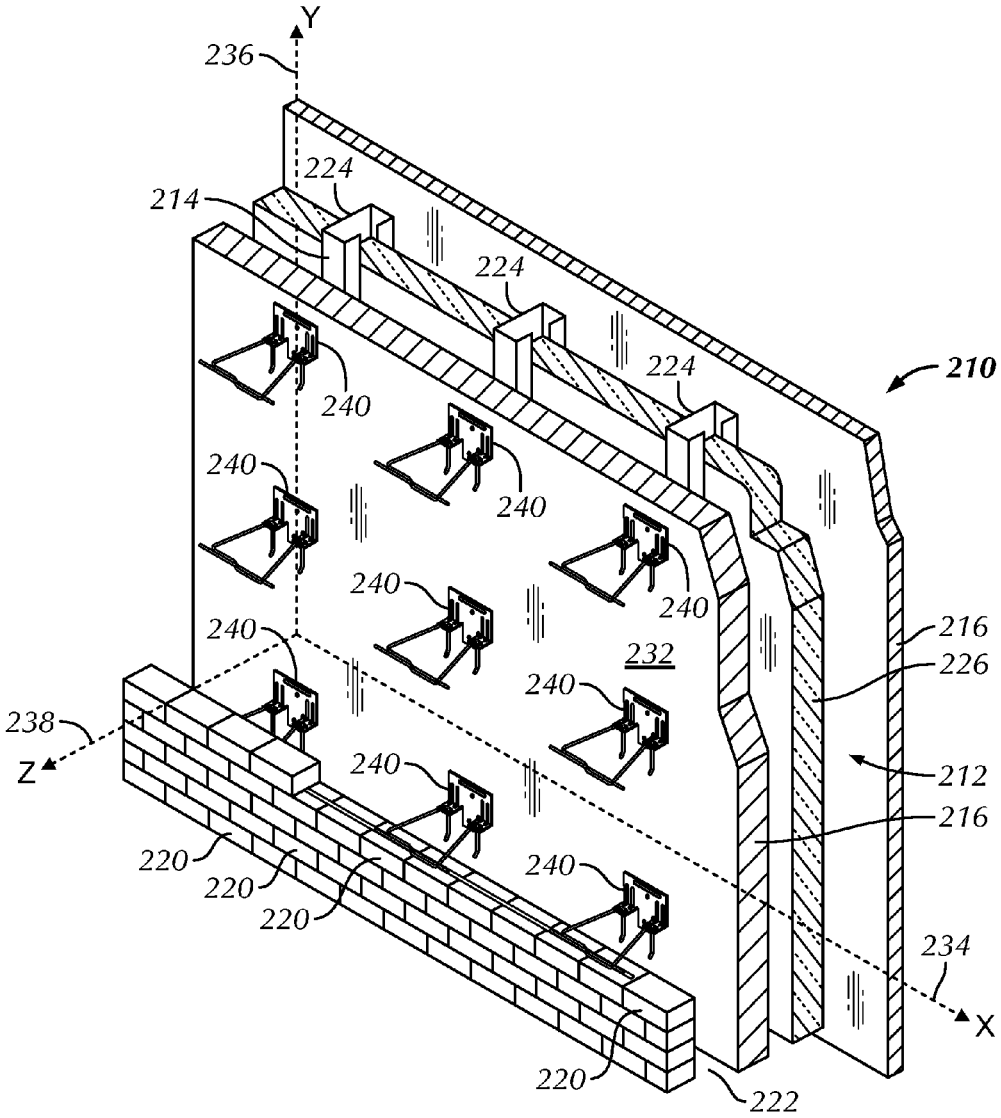
FIG. 6 is a perspective view of a third embodiment of an anchoring system having a veneer tie with high-strength pintles of this invention and provides for continuous wire reinforcement of a cavity wall structure, wherein the building system therefor includes a sheetmetal anchor for a drywall inner wythe and a swaged, interlocking snap-in wire tie.
Figure 7:
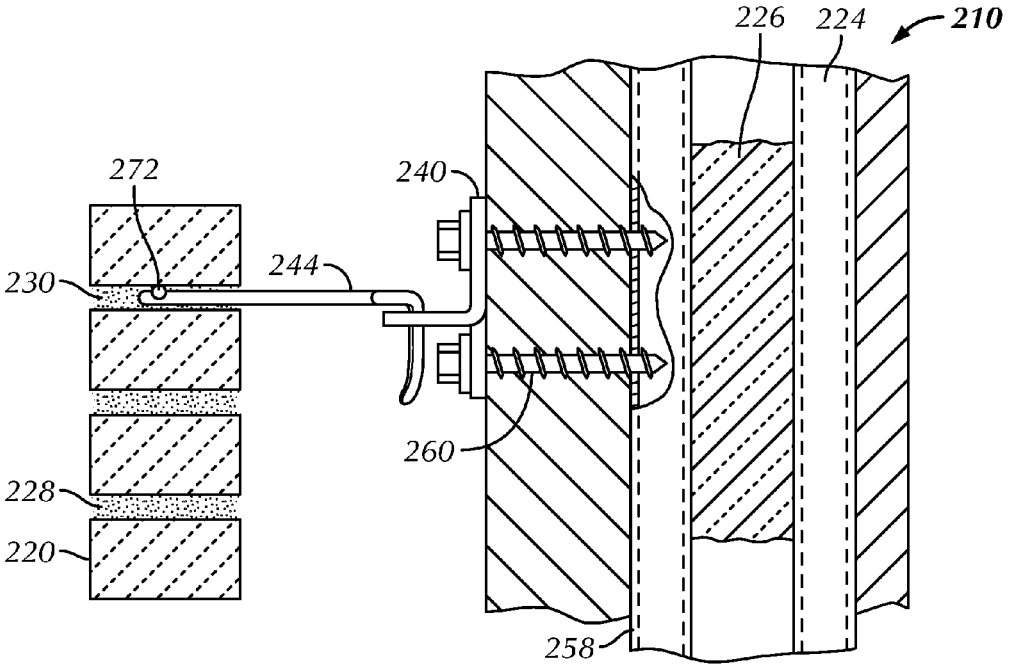
FIG. 7 is a cross-sectional view of FIG. 6 taken along a vertical plane that includes the longitudinal axis of one leg of the snap-in wire tie.
Figure 8:
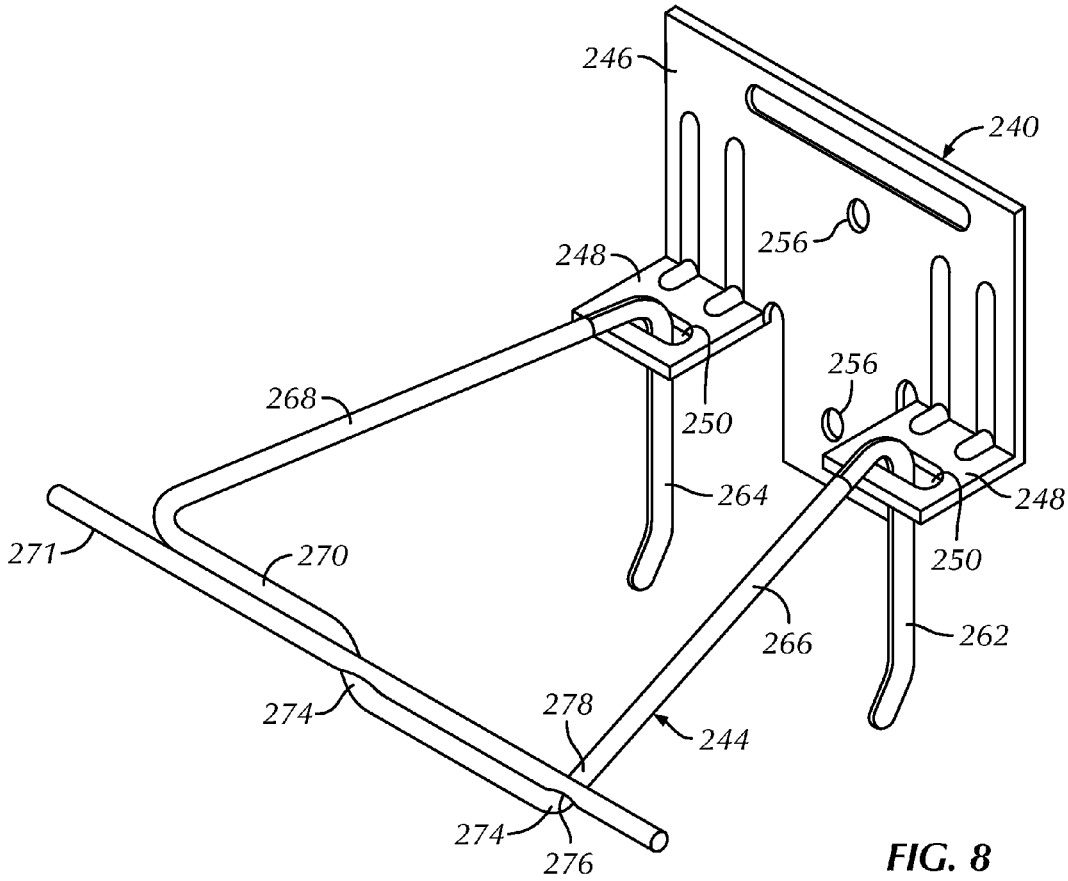
FIG. 8 is a partial perspective view of FIG. 6 showing details of the wall anchor, the veneer tie with high-strength pintles, and the continuous wire-reinforcement; and, FIG. 9 is a cross-sectional view of cold-worked wire used in the formation of the ribbon pintles hereof and showing resultant aspects of continued compression.

Referring now to FIGS. 6 to 8, the third embodiment of the high-strength pintle anchoring system is shown and is referred to generally by the numeral 210. The system 210 employs a sheetmetal wall anchor 240, Catalog #HB-200 manufactured by Hohmann and Barnard, Inc., a MiTek-Berkshire Hathaway company, Hauppauge, N.Y. 11788. The dry wall structure 212 is shown having an interior wythe 214 with a wallboard 216 as the interior and exterior facings thereof. An exterior or outer wythe 218 of facing brick 220 is attached to dry wall structure 212 and a cavity 222 is formed therebetween. The dry wall structure 212 is constructed to include, besides the wallboard facings 216, vertical channels 224 with insulation layers 226 disposed between adjacent channel members 224. Selected bed joints 228 and 230 are constructed to be in cooperative functional relationship with the veneer tie described in more detail below.

For purposes of discussion, the exterior surface 232 of the interior wythe 214 contains a horizontal line or x-axis 234 and an intersecting vertical line or y-axis 236. A horizontal line or z-axis 238 also passes through the coordinate origin formed by the intersecting x- and y-axes. The system 210 includes a dry wall anchor 240 constructed for attachment to vertical channel members 224, a 242 constructed for embedment in joint 228 and an interconnecting veneer tie member 244.

Reference is now directed to the L-shaped, surface-mounted sheetmetal bracket or wall anchor 240 comprising a mounting portion or base plate member 246 and free end projecting into the cavity 222 with pintle-receiving portion(s) 248. The projecting or extending portions 248 are punched-out from the base plate member 246 so as to have, upon installation, horizontally disposed apertures which, as best seen in FIG. 8, provide a pair of wire-tie-receiving receptors 250. The apertures are substantially circular configurations and are formed in plate members 248. Upon installation the projecting portions 248 are thus disposed substantially at right angles with respect to the plate member 246. To ease tolerance stack up receptors 250 may be slightly elongated along the x-axis thereof. The plate member 246 is also provided with mounting holes 256 at the upper and lower ends thereof.

As is best seen in FIG. 8, the projecting pintle-receiving portions 248 are spaced from the plate member 246 and are adapted to receive the pintles of veneer tie 244 therewithin. In the fabrication of the dry wall as the inner wythe of this construction system 210, the channel members 224 are initially secured in place. In this regard, the channel members 224 may also comprise the standard framing member of a building. Sheets of exterior wallboard 216, which may be of an exterior grade gypsum board, are positioned in abutting relationship with the forward flange 258 of the channel member 224. While the insulating layer 226 is shown as panels dimensioned for use between adjacent column 224, it is to be noted that any similarly suited rigid of flexible insulating material may be used herein with substantially equal efficacy.

After the initial placement of the flexible insulation layer 226 and the wallboard 216, the veneer anchors 240 are secured to the surface of the wallboard 216 in front of channel members 224. The sheetmetal Catalog #HB-200 (Hohmann & Barnard, Inc., Hauppauge, N.Y. 11788). Thereafter, sheetmetal screws 260 are inserted into the mounting holes 256 to fasten the anchor 240 to the flange 258 of channel member 224.

The veneer tie 244 is, when viewed either as a top or bottom elevation is substantially a U-shaped member and is dimensioned to be accommodated within apertures 250 previously described. The wire tie 244 has two rear leg portions or pintles 262 and 264, two side leg portions 266 and 268, and a front leg portion 270. The rear leg portions or pintles 262 and 264 are spaced apart by the spacing between apertures 250 of the projecting pintle-receiving portions 248. The longitudinal axes of leg portions 266, 268 and 270 are substantially coplanar. The rear leg portions 262 and 264 are structured to function cooperatively with the sizing of the apertures 250 of the projecting portions 248 to limit the x- and the y-axis movement of the construct.

The front leg portion 270 has been configured, as will be seen in the description that follows, to accommodate therewithin in a reinforcement wire or straight wire member 271 of predetermined diameter. The front leg portion 270 is attached to and is contiguous with side leg portions 266 and 268 and is structured to underlie the reinforcement wire while exerting a clamping pressure thereon. The anchoring system hereof meets building code requirements for seismic construction and the wall structure reinforcement of both the inner and outer wythes exceeds the testing standards therefor. In contradistinction to the first embodiment, the front leg portion 270 is disposed on both sides of the reinforcing wire 271 and has two housings 274 impressed therein. Each housing 274 have a pair of clamping jaws 276 and 278 which are spaced to require an insertion force of from 5 to 10 lbs. With this configuration the bed joint 228 height specification is readily maintained. As differentiated from the first two embodiments, the dry wall construction system 210 provides for the structural integrity by the securement of the veneer anchor construction to the channel member.

Figure 9:
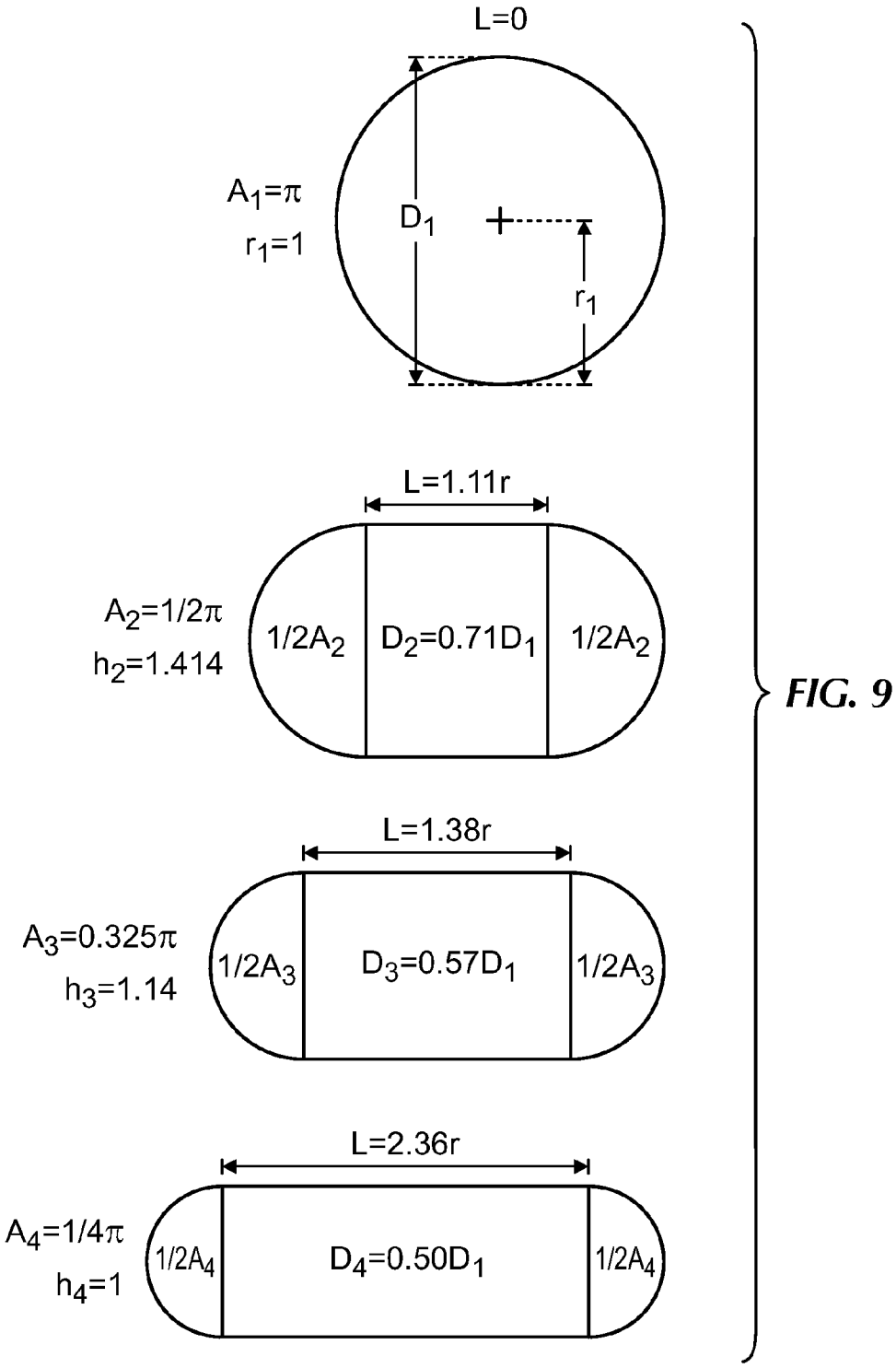

In FIG. 9, the compression of wire formatives is shown schematically. For purposes of discussion, the elongation of the compressed wire is disregarded as the elongation is negligible and the cross-sectional area of the construct remains substantially constant.

The third embodiment is for drywall inner wythe applications exposed to high compressive forces, such as high winds. First, in place of the standard 9-gage (0.148-inch diameter) wall reinforcement wire, a 3/16-inch (0.187-inch diameter) wire is used. Here, the veneer tie 244, and veneer reinforcing wire 271 are all formed from 0.187-inch diameter wire. In this regard, ribbon pintle 262 and 264 are reduced up to 75% of original diameter to a thickness of 0.113 inch. Additionally the indentation 278 of insertion portion 272 is reduced to a thickness of 0.110 inch. This enables the veneer reinforcing wire 271 to interlock with the veneer tie within the 0.300-inch tolerance. Although in this example compressive sizing is limited, the embodiment demonstrates the flexibility provided to architectural engineers by selectively compressing either or both the inner and outer wythe anchoring components.

Analytically, the circular cross-section of a wire provides greater flexural strength than a sheetmetal counterpart. In the embodiments described herein the ribbon pintles components of the veneer anchors are cold-worked or partially flattened so that the specification is maintained and high-strength ribbon pintles are provided. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween, FIG. 9. The deformed body has substantially the same cross-sectional area as the original wire. In each example in FIG. 9, progressive deformation of a wire is shown. Disregarding elongation and noting the prior comments, the topmost portion shows the original wire having a radius, $r_1=1$; and area, $A_1=\Pi$; length of deformation, L=0; and a diameter, $D_1$. Upon successive deformations, the illustrations shows the area of circular cross-section bring progressively ½, ⅜ and ¼ of the area, $A_1$, or $A_2=½\ \Pi$; $A_3=⅜\ \Pi$; and $A_4=¼\ \Pi$, respectively. With the first deformation, the rectangular portion has a length L=1.11 r (in terms of the initial radius of 1); a height, $h_3=1.14$; ($D_2=0.71D_1$, where D=diameter); and therefore has an area of approximately ½ Π. Likewise, with the second deformation, the rectangular portion has a length, L=1.38 r; a height, $h_3=1.14$; a diameter $D_3=0.57D_1$; and therefore has an area of approximately ⅝ Π. Yet again, with the third deformation, the rectangular portion has a length, L=2.36 r; a height $h_4=1$; a diameter, degree of plastic deformation to remain at a 0.300 inch (approx.) combined height for the truss and wall tie can, as will be seen hereinbelow, be used to optimize the high-span ribbon pintle anchoring system.

In testing the high-strength ribbon pintle described hereinabove, the test protocol is drawing from ASTM Standard E754-80 (Reapproved 2006) entitled, *Standard Test Method for Pullout Resistance of Ties and Anchors Embedded in Masonry Mortar Joints*. This test method is promulgated by and is under the jurisdiction of ASTM Committee E06 on Performance of Buildings.

In forming the ribbon pintles, the wire body of up to 0.375-inch in diameter is compressed up to 75% of the wire diameter. When compared to standard, wire formative pintles having diameters in the 0.172- to 0.195-inch range, a ribbon pintle reduced by one-third from the same stock as the standard pintle showed upon testing a tension and compression rating that was at least 130% of the rating for the standard pintle.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A high-strength pintle anchoring system for use in a wall having an inner wythe and an outer wythe in a spaced apart relationship the one with the other and having a cavity therebetween, said outer wythe formed from a plurality of courses with a bed joint of predetermined height between each two adjacent courses, said bed joint being filled with mortar, said system comprising:

a wall anchor fixedly attached to said inner wythe and having a free end thereof extending into said cavity, said free end of said wall anchor comprising:

one or more receptor portions disposed in said cavity, said one or more receptor portions being openings disposed substantially horizontally; and, a wire-formative veneer tie having an insertion end portion for disposition in said bed joint of said outer wythe and a ribbon pintle having a thickness and a width greater than the thickness, the width of the ribbon pintle being arranged so that it lies substantially within a generally vertical plane normal to either the outer or inner wythe when installed in the wall, the wire formative veneer tie further forming an interengaging end portion for disposition into said one or more receptor portions of said wall anchor.

2. A high-strength pintle anchoring system as described in claim 1 wherein said one or more receptors further comprise two eyelets spaced apart at a predetermined interval; and, said wire-formative veneer tie has two ribbon pintles formed by compressively reducing said interengaging end portion of said veneer tie with each of said ribbon pintles dimensioned to closely fit one of said openings of said two receptor portions.

3. A high-strength pintle anchoring system as described in claim 2 wherein each of said two eyelets is welded closed and has a substantially circular opening therethrough with a predetermined diameter.

4. A high-strength pintle anchoring system as described in claim 3 wherein said inner wythe is formed from successive courses of masonry block with a bed joint of predetermined height between each two adjacent courses and has a reinforcement ladder or truss in said bed joint, said wall anchor further comprising:

a wire formative fixedly attached to said reinforcement having at least two legs extending into and terminating within said cavity.

5. A high-strength pintle anchoring system as described in claim 4 wherein said receptor portions are two wire-formative eyelets disposed substantially horizontally in said cavity.

6. A high-strength pintle anchoring system as described in claim 3 wherein each of said two wire-formative eyelets is welded closed and has a substantially circular opening therethrough with a predetermined diameter.

7. A high-strength pintle anchoring system as described in claim 6 wherein said width of said ribbon pintles is in a close fitting functional relationship with said diameter of said eyelet.

8. A high-strength pintle anchoring system as described in claim 7 wherein the widths of said ribbon pintles are substantially parallel to the longitudinal axes of said legs of said wall anchor.

9. A high-strength pintle anchoring system as described in claim 8 wherein said veneer tie is a wire formative and said ribbon pintles of said interengaging end portion are compressively reduced in thickness up to 75% of an original diameter thereof.

10. A high-strength pintle anchoring system as described in claim 1 wherein said inner wythe is a dry wall structure having wallboard panels mounted on columns or framing members, said wall anchor further comprising:

a surface-mounted sheetmetal bracket fixedly attached to said columns of said inner wythe, said sheetmetal bracket being L-shaped and having a mounting portion and an extending portion for extending substantially horizontally into said cavity, said extending portion with said one or more receptor portions therethrough.

11. A high-strength pintle anchoring system as described in claim 10 wherein said one or more receptors further comprise two apertures spaced apart at a predetermined interval; and, said wire-formative veneer tie has two ribbon pintles formed by compressively reducing said interengaging end portion of said veneer tie.

12. A high-strength pintle anchoring system as described in claim 11 wherein each of said two apertures are shaped substantially similar to the cross section of said ribbon pintles.

13. A high-strength pintle anchoring system as described in claim 11 wherein said width of said ribbon pintles is in a close fitting functional relationship with the opening of said aperture.

14. A high-strength pintle anchoring system as described in claim 11 wherein the major cross-sectional axes of said ribbon pintles are substantially normal to said wallboard panels.

15. A high-strength pintle anchoring system for use in a cavity wall formed from a backup wall and a facing wall in a spaced apart relationship with a vertical surface of the backup wall forming one side of a cavity therebetween, said cavity in excess of four inches, said backup wall formed from a plurality of successive courses of masonry block with a bed joint of predetermined height between each two adjacent courses, said high-strength pintle anchoring system comprising, in combination:

a wall reinforcement adapted for mounting in said bed joint of said backup wall;

at least one wall anchor fusibly attached at an attachment end thereof to said wall reinforcement, and, upon installation in said bed joint of said backup wall, extending from an attachment end thereof to the vertical surface of said backup wall; said wall anchor, in turn, comprising:

an extended leg portion for spanning said cavity, said extended leg portion having a free end contiguous therewith, opposite said attachment end, and having one or more receptor portions therein; and, a wire-formative veneer tie having an insertion end portion for disposition in said bed joint of said outer wythe and ribbon pintles, each ribbon pintle having a thickness and a width greater than the thickness forming an interengaging end portion for disposition into said one or more receptor portions of said wall anchor, the veneer tie further including a front and a rear, the insertion end portion of the veneer tie being located at the front of the veneer tie and the ribbon pintles being located at the rear of the veneer tie, the width of each ribbon pintle lying in a plane extending in a direction between the front of the veneer tie and the rear of the veneer tie.

16. A high-strength pintle anchoring system as described in claim 15 wherein said wall anchor has two extended leg portions each having a receptor, said receptors further comprise two eyelets spaced apart at a predetermined interval; and, said wire-formative veneer tie has two ribbon pintles formed by compressively reducing said interengaging end portion of said veneer tie with each of said ribbon pintles dimensioned to closely fit one of said openings of said two receptor portions.

17. A high-strength pintle anchoring system as described in claim 16 wherein each of said two eyelets is welded closed and has a substantially circular opening therethrough with a predetermined diameter.

18. A high-strength pintle anchoring system as described in claim 17 wherein said receptor portions are two wire-formative eyelets disposed substantially horizontally in said cavity.

19. A high-strength pintle anchoring system as described in claim 18 wherein said width of said ribbon pintles is in a close fitting functional relationship with said diameter of said eyelet.

20. A high-strength pintle anchoring system as described in claim 19 wherein the widths of said ribbon pintles are substantially parallel to the longitudinal axes of said legs of said wall anchor.

21. A high-strength pintle anchoring system as described in claim 20 wherein said veneer tie is a wire formative and said ribbon pintles of said interengaging end portion are compressively reduced in thickness up to 75% of an original diameter thereof.

22. A high-strength pintle anchoring system as described in claim 21, wherein said veneer tie is fabricated from a wire having a diameter of up to 0.375-inch and wherein said interengaging end portion thereof is compressively reduced up to 75%.

23. A high-strength pintle anchoring system as described in claim 22, wherein said ribbon pintle is fabricated from a 3/16-inch wire, and when reduced by one-third has a tension and compression rating at least 130% of the rating for a non-reduced pintle.

24. A high-strength pintle anchoring system as described in claim 1, wherein said ribbon pintle has a cross section with substantially semicircular ends and flat surfaces therebetween.

25. A high-strength pintle anchoring system as described in claim 1, wherein the width of the ribbon pintle extends perpendicular to the thickness of the ribbon pintle.

26. A high-strength veneer tie comprising:

an insertion end portion;

a pair of side legs, each side leg having a first end extending from the insertion end portion and a second end opposite the first end; and a pair of ribbon pintles, each ribbon pintle extending generally perpendicular from the second end of one of the side legs, each ribbon pintle having a thickness and a width greater than the thickness, the veneer tie further including a front and a rear, the insertion end portion of the veneer tie being located at the front of the veneer tie and the ribbon pintles being located at the rear of the veneer tie, the width of each ribbon pintle lying in a plane extending in a direction between the front of the veneer tie and the rear of the veneer tie.

* * * * *